US010699618B2

(12) United States Patent
Huang et al.

(10) Patent No.: US 10,699,618 B2
(45) Date of Patent: Jun. 30, 2020

(54) INTEGRATED CIRCUIT AND ANTI-INTERFERENCE METHOD THEREOF

(71) Applicant: Novatek Microelectronics Corp., Hsinchu (TW)

(72) Inventors: Chih-Hao Huang, Tainan (TW); Wei-Sheng Tseng, Hsinchu County (TW); Yao-Hung Kuo, Hsinchu (TW); Hao-Wei Hung, New Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/231,418

(22) Filed: Dec. 22, 2018

(65) Prior Publication Data

US 2019/0340968 A1 Nov. 7, 2019

Related U.S. Application Data

(60) Provisional application No. 62/666,662, filed on May 3, 2018.

(51) Int. Cl.
*G09G 3/20* (2006.01)
*G09G 5/00* (2006.01)

(52) U.S. Cl.
CPC ..... *G09G 3/20* (2013.01); *G09G 5/008* (2013.01); *G09G 2310/0291* (2013.01);
(Continued)

(58) Field of Classification Search
CPC ..... G09G 2330/06; G09G 3/3685; G09G 2310/08; G09G 2310/027;
(Continued)

(56) References Cited

U.S. PATENT DOCUMENTS 8,237,699 B2 * 8/2012 Hong ..... G09G 3/2096 345/213
8,390,614 B2 * 3/2013 Fan ..... H03L 7/06 327/147

(Continued)

FOREIGN PATENT DOCUMENTS

CN 201845326 5/2011
CN 107154243 9/2017

OTHER PUBLICATIONS

"Office Action of Taiwan Counterpart Application", dated Jan. 9, 2020, pp. 1-5.

*Primary Examiner* — Koosha Sharifi-Tafreshi
(74) *Attorney, Agent, or Firm* — JCIPRNET

(57) ABSTRACT

An integrated circuit for driving a display panel and an anti-interference method are provided. The integrated circuit includes a source driving circuit and an anti-interference circuit. The source driving circuit includes a receiving circuit configured to receive an input signal including image data and process the input signal based on at least one operation parameter to generate output data. The anti-interference circuit is coupled to the receiving circuit. The anti-interference circuit determines whether an interference event occurs to the input signal based on the input signal or the output data to obtain a determination result and determines whether to adjust the at least one operation parameter of the receiving circuit according to the determination result.

17 Claims, 9 Drawing Sheets

(52) U.S. Cl.
CPC ..... *G09G 2310/06* (2013.01); *G09G 2320/08* (2013.01); *G09G 2330/06* (2013.01); *G09G 2330/12* (2013.01)

(58) Field of Classification Search
CPC ..... G09G 2310/0291; G09G 2370/08; G09G 2310/0289; G09G 5/008; G09G 3/3696; G09G 2330/12; G09G 2310/06; G09G 2320/08
USPC ..... 345/99, 204–215
See application file for complete search history.

(56) References Cited

U.S. PATENT DOCUMENTS

| | | | | |
|---|---|---|---|---|
| 9,049,092 | B2 * | 6/2015 | Sugiyama | H04L 25/49 |
| 2010/0231787 | A1 * | 9/2010 | Kim | G09G 3/2096 348/503 |
| 2017/0132966 | A1 * | 5/2017 | Lim | G09G 3/2092 |

* cited by examiner

INTEGRATED CIRCUIT AND ANTI-INTERFERENCE METHOD THEREOF

CROSS-REFERENCE TO RELATED APPLICATION

This application claims the priority benefits of U.S. provisional application Ser. No. 62/666,662, filed on May 3, 2018. The entirety of the above-mentioned patent application is hereby incorporated by reference herein and made a part of this specification.

BACKGROUND

Field of the Invention

The invention relates to an electronic circuit and more particularly, to an integrated circuit and an anti-interference method thereof.

Description of Related Art

When a mobile phone (or another radio frequency (RF) device) approaches a display apparatus, RF noise may cause abnormality to a display screen of the display apparatus. One of the reasons causing the abnormality is that the RF noise of the mobile phone may interfere with transmission of data signal between a timing controller and a source driving circuit.

FIG. 1 is a schematic diagram of a scenario where a mobile phone 110 approaches a display apparatus 120. A timing controller 121 transmits a data signal to a source driving circuit 122 through a transmission line, and the source driving circuit 122 drives a display panel 123 according to the data signal to display an image. When the mobile phone 110 approaches the display apparatus 120, a RF noise 111 of the mobile phone 110 may interfere with the transmission of the data signal between the timing controller 121 and the source driving circuit 122. When the energy of the RF noise in the data signal is sufficiently large, the source driving circuit 122 may be incapable of correctly latching the data signal.

FIG. 2 is a schematic diagram of a scenario where a signal received by the source driving circuit 122 depicted in FIG. 1 is interfered by the RF noise. In FIG. 2, the horizontal axis represents the time, Rx represents the data signal received by the source driving circuit 122, and CDR_CLK represents a clock signal received by a clock and data recovery (CDR) circuit disposed inside the source driving circuits 122. As illustrated in the left part of FIG. 2, when the RF noise 111 does not occur yet, i.e., no interference event occurs yet, the CDR circuit disposed inside the source driving circuit 122 may correctly lock the data signal Rx, i.e., a phase of the data signal Rx meets a phase of the clock signal CDR_CLK. When the RF noise 111 occurs, i.e., an interference event occurs, the RF noise 111 may interfere with the data signal Rx, such that the phase of the data signal Rx may not meet the phase of the clock signal CDR_CLK. Namely, the CDR circuit disposed inside the source driving circuit 122 may trigger loss of lock to the data signal Rx. When the source driving circuit 122 is incapable of correctly locking the data signal Rx, the display panel of the display apparatus 120 certainly is incapable of displaying a correct image.

SUMMARY

The invention provides an integrated circuit and an anti-interference method for self-determining whether an interference event occurs to an input signal from the external, so as to determine whether to adjust at least one operation parameter of a receiving circuit according to the determination result.

According to an embodiment of the invention, an integrated circuit configured to drive a display panel is provided. The integrated circuit includes a source driving circuit and an anti-interference circuit. The source driving circuit includes a receiving circuit, and configured to receive an input signal including image data and process the input signal based on at least one operation parameter to generate output data. The anti-interference circuit is coupled to the receiving circuit. The anti-interference circuit determines whether an interference event occurs to the input signal based on the input signal or the output data to obtain a determination result and determines whether to adjust the at least one operation parameter of the receiving circuit according to the determination result.

According to an embodiment of the invention, an anti-interference method of an integrated circuit is provided. The integrated circuit is configured to drive a display panel. The anti-interference method includes: receiving an input signal including image data by a receiving circuit of a source driving circuit in an integrated circuit; processing the input signal based on at least one operation parameter by the receiving circuit to generate output data; determining whether an interference event occurs to the input signal based on the input signal or the output data by an anti-interference circuit to obtain a determination result; and determining whether to adjust the at least one operation parameter of the receiving circuit according to the determination result by the anti-interference circuit.

To sum up, the receiving circuit of the integrated circuit provided by the embodiments of the invention can process the input signal from the external based on the at least one operation parameter, so as to generate the output data to other internal circuits. The anti-interference circuit of the integrated circuit can determine whether any interference event occurs to the input signal, so as to determine whether to adjust the at least one operation parameter of the receiving circuit according to the determination result.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
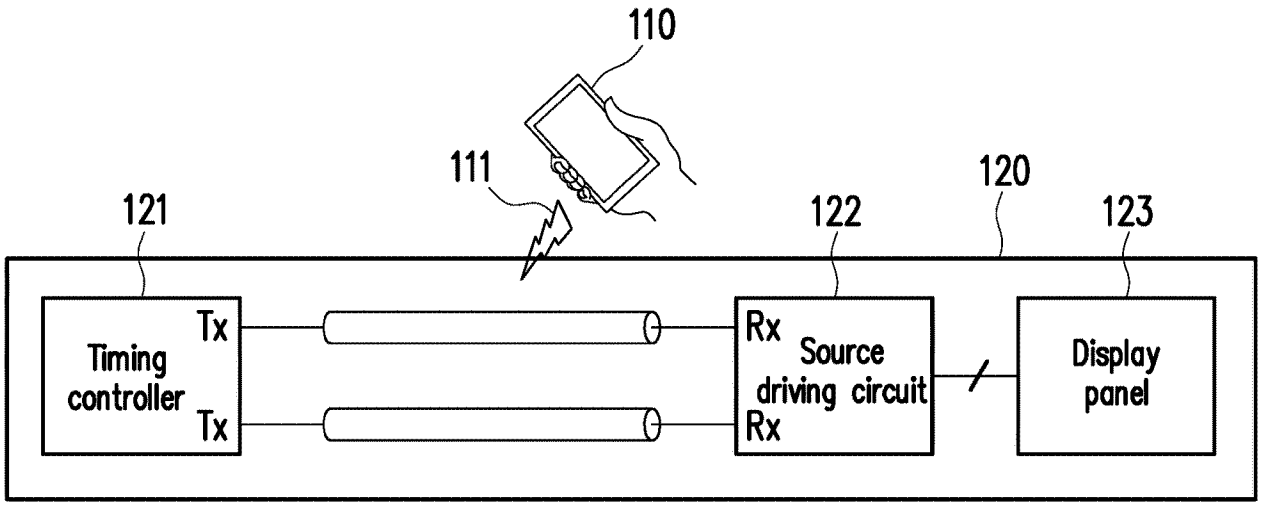
FIG. 1 (PRIOR ART)
FIG. 1 is a schematic diagram of a scenario where a mobile phone approaches a display apparatus.
Figure 2:
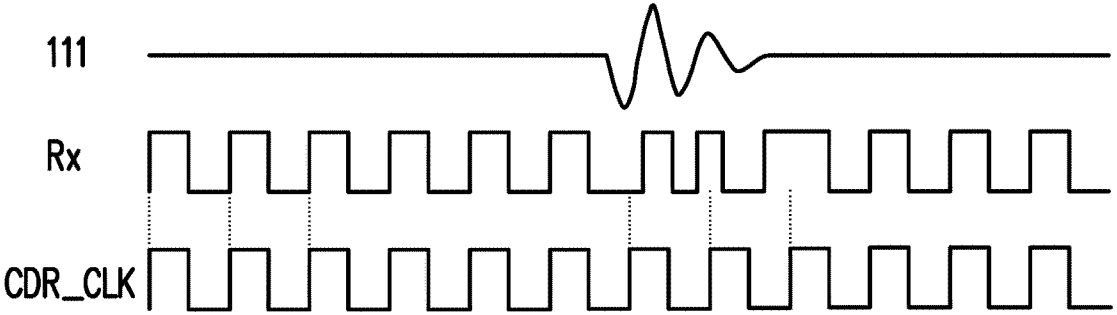
FIG. 2 (PRIOR ART)
FIG. 2 is a schematic diagram of a scenario where a signal received by the source driving circuit depicted in FIG. 1 is interfered by the radio frequency (RF) noise.

The term "couple (or connect)" herein (including the claims) are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. Moreover, elements/components/steps with same reference numerals represent same or similar parts in the drawings and embodiments. Elements/components/notations with the same reference numerals in different embodiments may be referenced to the related description.

Figure 3:
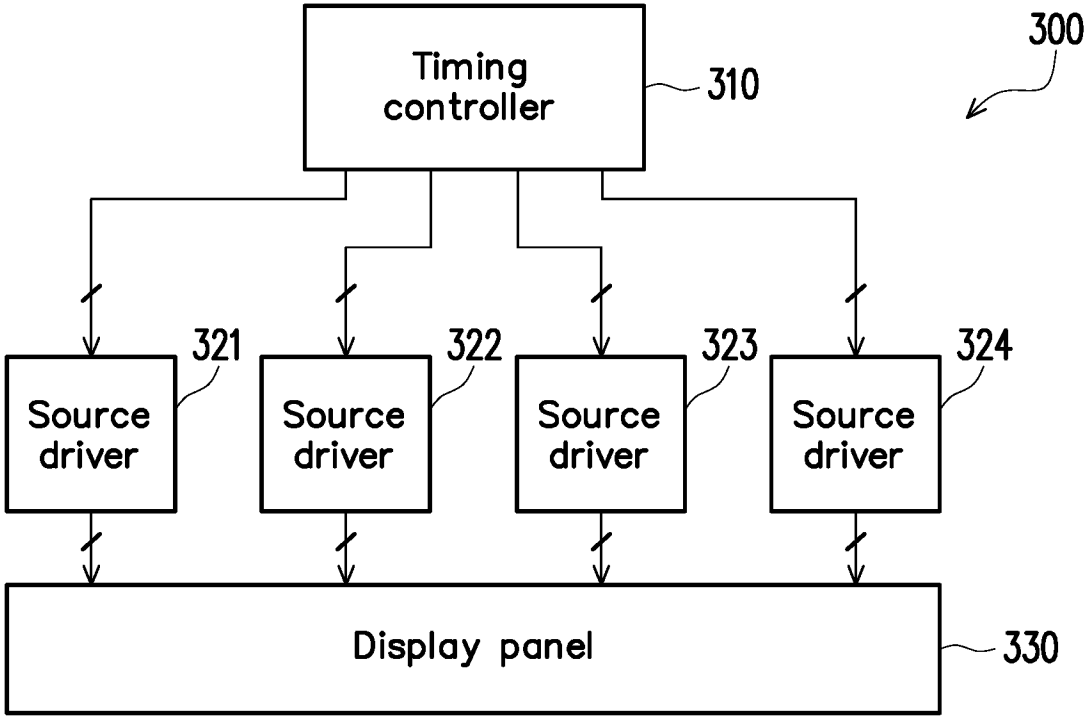
FIG. 3 is a schematic circuit block diagram of a display apparatus according to an embodiment of the invention.

FIG. 3 is a schematic circuit block diagram illustrating a display apparatus 300 according to an embodiment of the invention. The display apparatus 300 includes a plurality of integrated circuits, for example, a timing controller 310 and one or more source drivers, as illustrated in FIG. 3. In FIG. 3, four source drivers 321, 322, 323 and 324 are illustrated; however, in any way, the number of the source drivers may be determined based on a design requirement. The display apparatus 300 further includes a display panel 330. The timing controller 310 transmit a data signal to each of the source drivers 321-324 through transmission lines (for example, conductive wires of a printed circuit board (PCB)), and the source drivers 321-324 drive the display panel 330 according to the data signal to display an image. The implementation manners of the timing controller 310 and the display panel 330 are not limited in the present embodiment. Based on a design requirement, for example, the timing controller 310 may be a conventional timing controller or other control circuits/elements, and the display panel may be a conventional display panel or other types of display panels. In some embodiments, the data signal may not be limited to representing only data information and may represent more control information such as timing control information. In alternative or the same embodiments, the timing controller 310 can transmit one or more other signals to each of the source drivers 321-324.

A receiving circuit disposed inside each of the source drivers 321-324 may receive the data signal from the timing controller 310. The receiving circuit processes the data signal (i.e., an input signal) based on at least one operation parameter, so as to generate output data to other internal circuits (which are not shown). An anti-interference circuit disposed in each of the source drivers 321-324 may determine whether an interference event occurs to the input signal based on the input signal and/or the output data of the receiving circuit to obtain a determination result. The "interference event" as referred to may be defined as a RF noise occurring to the input signal and/or the energy of the RF noise being sufficiently large to interfere with the data signal (for example, the input signal of the receiving circuit). Based on a design requirement, the "interference event" includes a common-mode interference event, a high frequency interference event, a low frequency interference event and/or other interference events.

The anti-interference circuit may determine whether to adjust the at least one operation parameter of the receiving circuit according to the determination result. For example, when no interference event occurs, the anti-interference circuit may maintain the at least one operation parameter of each receiving circuit at least one normal parameter. When an interference event occurs to the input signal of any one of the source drivers 321-324, the anti-interference circuit may correspondingly adjust at least one corresponding operation parameter of the receiving circuit of the source driver whose input signal is interfered, for example, adjust the at least one operation parameter of the receiving circuit of the source driver from the at least one normal parameter to at least one anti-interference parameter. After the at least one operation parameter is adjusted to the at least one anti-interference parameter, the anti-interference circuit may determine whether to return the at least one operation parameter from the at least one anti-interference parameter to the at least one normal parameter after a predetermined time period. For example, in some embodiments, after the at least one operation parameter is adjusted to the at least one anti-interference parameter, the anti-interference circuit may again determine whether the interference event occurs to the input signals during a blank period between a current frame and a next frame. In a condition that the interference event has disappeared, the anti-interference circuit may determine to return the at least one operation parameter from the at least one anti-interference parameter to the at least one normal parameter. Alternatively, the anti-interference circuit may be configured to return the at least one operation parameter from the at least one anti-interference parameter to the at least one normal parameter after a predetermined time period without determining whether the interference event occurs to the input signals.

The at least one operation parameter may be determined based on a design requirement. For example, the at least one operation parameter may include at least one operation parameter of a receiving amplifier of each receiving circuit, at least one operation parameter of a clock and data recovery (CDR) circuits of each receiving circuit and/or other operation parameters. In some embodiments, the at least one operation parameter may include a high frequency gain, a low frequency gain, a ratio of the high frequency gain to the low frequency gain, a bias current, a resistance value, a capacitance value and/or other operation parameters of the receiving amplifier. For example, when the interference event occurs to the input signal of any one of the source drivers 321-324, the anti-interference circuit may adjust the at least one operation parameter of the receiving amplifier to increase a signal to noise ratio (SNR) of an output signals of the receiving amplifier. In some other embodiments, the at least one operation parameter includes a bandwidth of each CDR circuit. For example, when the interference event includes a high frequency interference component, the anti-interference circuit may decrease the bandwidth of the CDR circuit. For example, when the interference event includes a low frequency interference component, the anti-interference circuit may increase the bandwidth of the CDR circuit.

Figure 4:
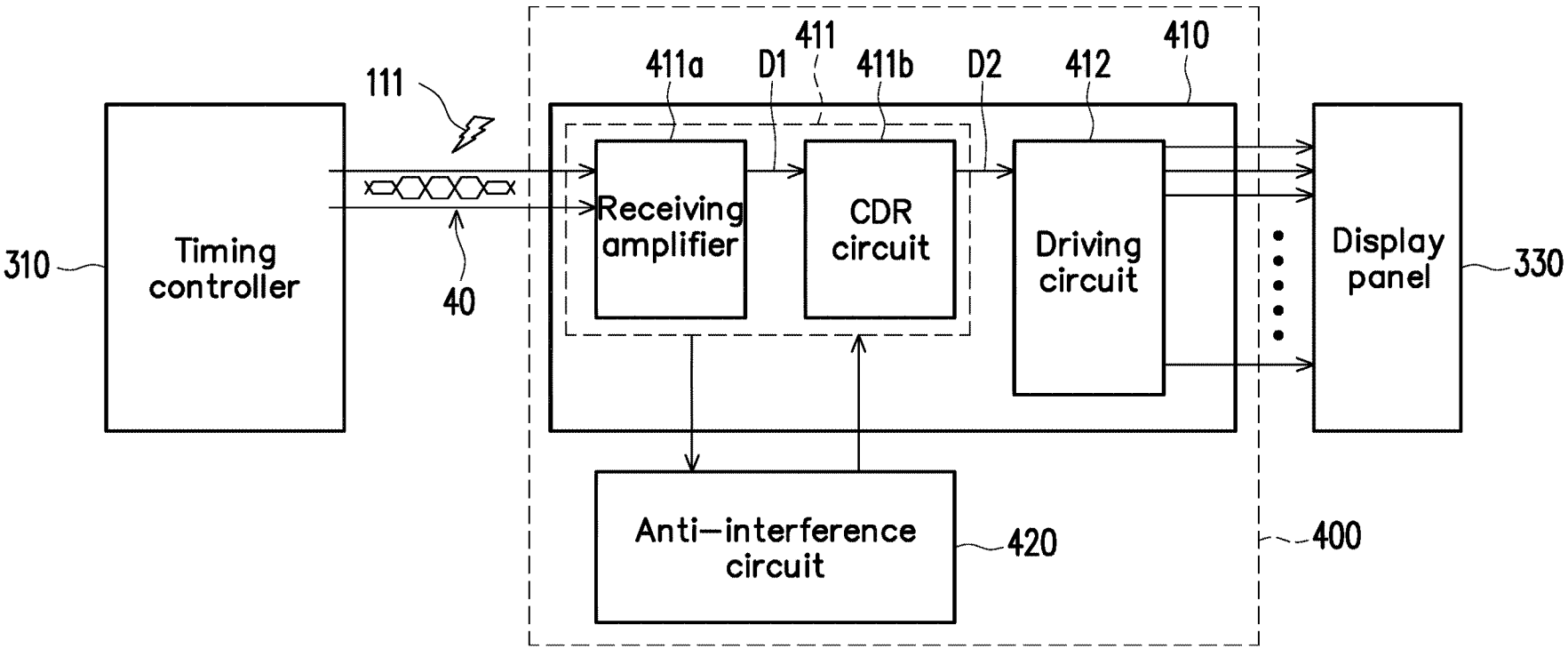
FIG. 4 is a schematic circuit block diagram of an integrated circuit according to an embodiment of the invention.

FIG. 4 is a schematic circuit block diagram of an integrated circuit 400 according to an embodiment of the invention. The integrated circuit 400 is configured to drive the display panel 330. The source drivers 321-324 illustrated in FIG. 3 may be inferred with reference to the description related to the integrated circuit 400 illustrated in FIG. 4, and the integrated circuit 400 illustrated in FIG. 4 may also refer to the description related to the source drivers 321-324 illustrated in FIG. 3. In the embodiment illustrated in FIG. 4, the integrated circuit 400 includes a source driving circuit 410 and an anti-interference circuit 420. The source driving circuit 410 is coupled to the timing controller 310. A data signal provided by the timing controller 310 may serve as an input signal 40 of the source driving circuit 410. Based on the input signal 40, the driving circuit 410 may drive the display panel 330 to display a corresponding image.

In the embodiment illustrated in FIG. 4, the source driver circuit 410 includes a receiving circuit 411 and a driving circuit 412. The receiving circuit 411 may receive the input signal 40 including image data from another external integrated circuit (for example, the timing controller 310). Based on one or more operation parameters, the receiving circuit 411 may process the input signal 40 to generate output data D2. The driving circuit 412 is coupled to the receiving circuit 411 to receive the output data D2. Based on the output data D2, the driving circuit 412 may drive the display panel 330 to display a corresponding image. The implementation manner of the driving circuit 412 is not limited in the invention. Based on a design requirement, for example, the driving circuit 412 may include a shift register, a data register, a level shifter, a digital-to-analog converter (DAC) and an output buffer. In some embodiments, the driving circuit 412 may be a conventional panel driving circuit or other driving circuits/elements.

In the embodiment illustrated in FIG. 4, the source driver circuit 411 includes a receiving amplifier 411*a* and a CDR circuit 411*b*. Based on a design requirement, the receiving amplifier 411*a* may include an equalizer, a differential amplifier and/or other amplification circuits/elements. The receiving amplifier 411*a* may receive the input signal 40. The receiving amplifier 411*a* may perform an equalization operation and/or a gain operation on the input signal 40 based on one or more operation parameters to generate an input signal D1. The CDR circuit 411*b* is coupled to the receiving amplifier 411*a* to receive the input signal D1. The CDR circuit 411*b* may recover image data and a clock from the input signal D1 based on the one or more operation parameters to generate the output data D2 and an output clock to the driving circuit 412. Based on a design requirement, in some embodiments, the receiving amplifier 411*a* may be a conventional amplifier, a conventional equalizer or other equalizer circuits/gain circuits, and the CDR circuit 411*b* may be a conventional CDR circuit or other CDR circuits.

When the interference event does not yet occur to the input signal 40 (for example, the RF noise 111 does not yet occur, or the energy of the RF noise 111 is insufficient to interfere with the input signal 40), the CDR circuit 411*b* may correctly lock the data signal (i.e., the input signal 40) provided by the timing controller 310. When an interfering source such as a mobile phone approaches the display apparatus 300, the RF noise 111 of the mobile phone may interfere with the transmission of the data signal (i.e., the input signal 40) between the timing controller 310 and the integrated circuit 400. When the energy of the RF noise in the input signal 40 is sufficiently large, the CDR circuit 411*b* may probably be incapable of correctly locking the input signal 40.

Figure 5:
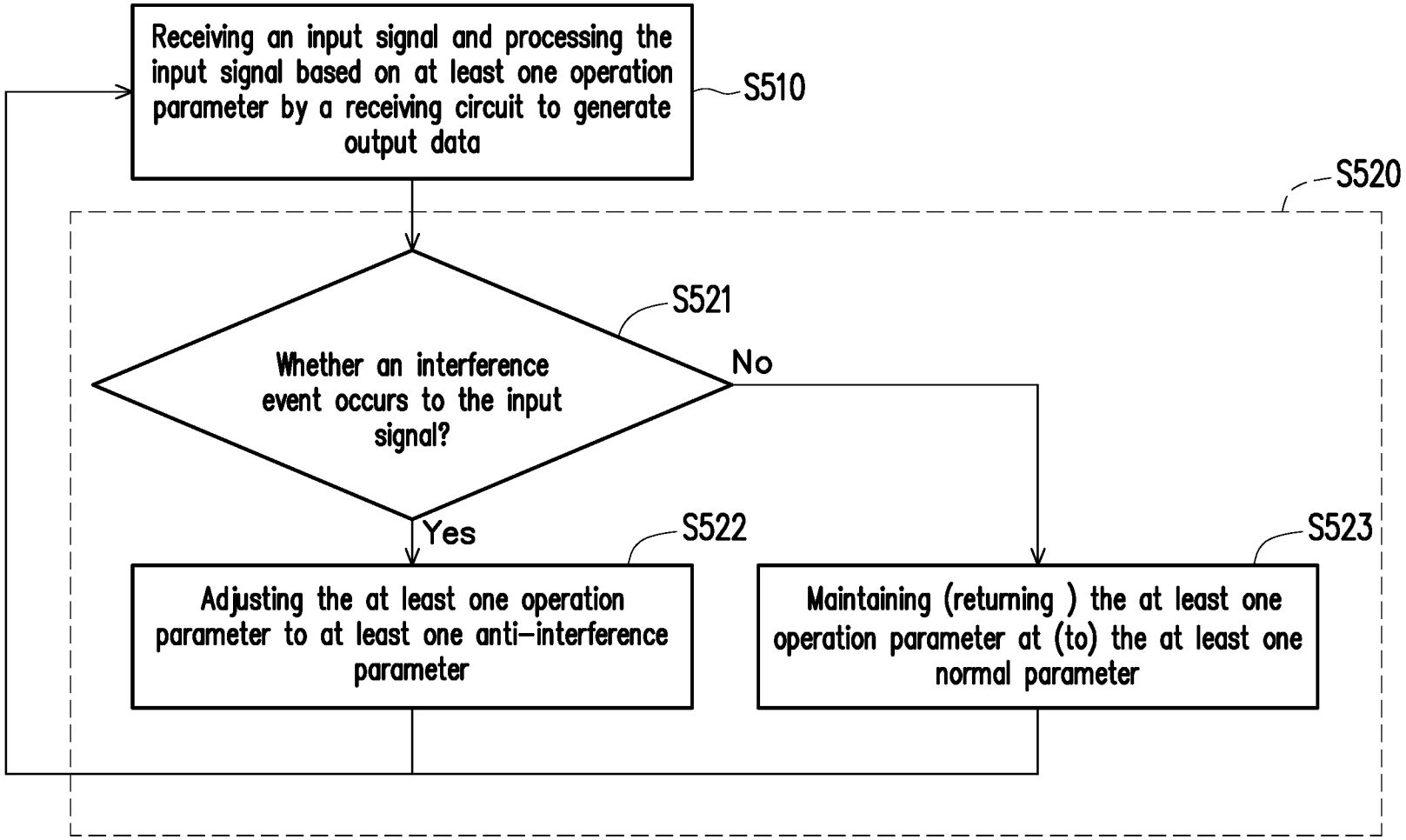
FIG. 5 is a flowchart of an anti-interference method of an integrated circuit according to an embodiment of the invention.

FIG. 5 is a flowchart of an anti-interference method of an integrated circuit according to an embodiment of the invention. Referring to FIG. 4 and FIG. 5, in step S510, the receiving circuit 411 of the source driving circuit 410 in the integrated circuit 400 may receive the input signal 40 including the image data from another external integrated circuit (for example, the timing controller 310). The receiving circuit 411, in step S510, may process the input signal 40 based on one or more operation parameters to generate the output data D2 to the driving circuit 412.

The anti-interference circuit 420 is coupled to the receiving circuit 411. In step S520, the anti-interference circuit 420 may determine whether an interference event occurs to the input signal 40 based on the input signal 40 and/or the output data D2 to obtain a determination result. Based on a design requirement, the "interference event" as referred to includes a common-mode interference event, a high frequency interference event, a low frequency interference event and/or other interference events. The anti-interference circuit 420, in step S520, may determine whether to adjust the at least one operation parameter of the receiving circuit 411 according to the determination result. For example, the anti-interference circuit 420 may detect a frequency of the input signal 40, a common-mode level of the input signal 40, a swing of the input signal 40, an error code count of the output data D2 and/or other electric characteristics to obtain a detection result (i.e., the determination result). The anti-interference circuit 420 may determine whether to adjust the at least one operation parameter of the receiving circuit 411 according to the detection result.

For example, when the interference event does not occur, the anti-interference circuit 420 may maintain the at least one operation parameter of the receiving circuit 411 at least one normal parameter. When the interference event occurs to the input signal 40, the anti-interference circuit 420 may correspondingly adjust at least one corresponding operation parameter of the receiving circuit 411, for example, adjust the at least one operation parameter of the receiving circuit 411 from the at least one normal parameter to at least one anti-interference parameter. After the at least one normal parameter operation parameter is adjusted to the at least one anti-interference parameter, the anti-interference circuit 420 may determine whether to return the at least one normal parameter operation parameter from the at least one anti-interference parameter after a predetermined time period. For example, in some embodiments, after the at least one normal parameter operation parameter is adjusted to the at least one anti-interference parameter, the anti-interference circuit 420 may again determine whether the interference event occurs to the input signal 40 during a blank period of a next frame. In a condition that the interference event has disappeared, the anti-interference circuit 420 may determine to return the at least one normal parameter operation parameter from the at least one anti-interference parameter to the at least one normal parameter.

The at least one operation parameter adjusted by the anti-interference circuit 420 may be determined based on a design requirement. For example, the at least one operation parameter may include at least one operation parameter of the receiving amplifier 411*a*, at least one operation parameter of the CDR circuit 411*b* and/or other operation parameters. In some embodiments, the at least one operation parameter may include a high frequency gain, a low frequency gain, a ratio of the high frequency gain to the low frequency gain, a bias current, a resistance value, a capacitance value and/or other operation parameters of the receiving amplifier 411*a*. For example, when the interference event occurs to the input signal 40, the anti-interference circuit 420 may adjust the at least one operation parameter of the receiving amplifier 411*a* to increase a signal to noise ratio (SNR) of the output signal (the input signal D1) of the receiving amplifier 411*a*. In a condition that the receiving amplifier 411*a* includes a conventional equalizer, when the interference event occurs, the anti-interference circuit 420 may adjust a resistance value, a capacitance value and/or a bias current of the equalizer to increase the SNR of the input signal D1.

In some other embodiments, the at least one operation parameter adjusted by the anti-interference circuit 420 may be include a bandwidth of the CDR circuit 411*b*. For example, when the interference event includes a high frequency interference component, the anti-interference circuit 420 may decrease the bandwidth of the CDR circuit 411*b*. When the interference event includes a low frequency interference component, the anti-interference circuit 420 may increase the bandwidth of the CDR circuit 411*b*.

In the embodiment illustrated in FIG. 5, step S520 may include steps S521 and S523. In other embodiments, step S520 may also include other steps. In step S521, the anti-interference circuit 420 may determine whether the interference event occurs to the input signal 40 based on the input signal 40 and/or the output data D2. When the interference event does not occur (i.e., the determination result of step S521 is "No"), the anti-interference circuit 420 may maintain the at least one operation parameter of the receiving circuit 411 at the at least one normal parameter (step S523) and then, returns to step S510. When the interference event occurs to an input signal 40 (i.e., the determination result of step S521 is "Yes"), the anti-interference circuit 420 may adjust the at least one operation parameter of the receiving circuit 411 from the at least one normal parameter to the at least one anti-interference parameter (step S522) and then, returns to step S510.

After the at least one operation parameter of the receiving circuit 411 is adjusted to the at least one anti-interference parameter, the anti-interference circuit 420 may again perform step S521 after a predetermined time period, so as to determine whether to return the at least one operation parameter of the receiving circuit 411 from the at least one anti-interference parameter to the at least one normal parameter. For example, in some embodiments, the anti-interference circuit 420 may again determine whether the interference event occurs to the input signal 40 during a blank period of a next frame. In a condition that the interference event has disappeared (i.e., the determination result of step S521 is "No"), the anti-interference circuit 420 may determine to return the at least one operation parameter of the receiving circuit 411 from the at least one anti-interference parameter to the at least one normal parameter (step S523).

The at least one operation parameter may be determined/selected based on a design requirement. For example, the at least one operation parameter of the receiving circuit 411 may include one or more operation parameters of the receiving amplifier 411*a* (i.e., the equalizer), one or more operation parameters of the CDR circuit 411*b* and/or other operation parameters. In some embodiments, the one or more operation parameter of the receiving circuit 411 may include a high frequency gain, a low frequency gain, a ratio of the high frequency gain to the low frequency gain, a bias current, a resistance value, a capacitance value and/or other operation parameters of the receiving amplifier 411*a*. When the interference event occurs to an input signal 40, the anti-interference circuit 420 may adjust the at least one operation parameter of the receiving amplifier 411*a* to increase the SNR of the output signal (the input signal D1) of the receiving amplifier 411*a*. In some other embodiments, the at least one operation parameter of the receiving circuit 411 may also include the bandwidth of the CDR circuit 411*b*. When the interference event includes a high frequency interference component, the anti-interference circuit 420 may decrease the bandwidth of the CDR circuit 411*b*. When the interference event includes a low frequency interference component, the anti-interference circuit 420 may increase the bandwidth of the CDR circuit 411*b*.

Figure 6:
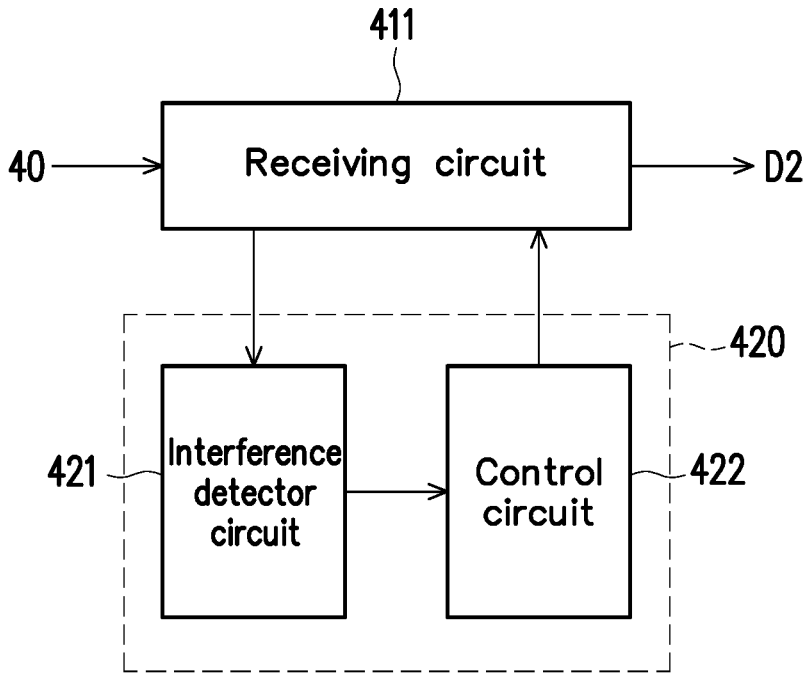
FIG. 6 is a schematic circuit block diagram of the anti-interference circuit depicted in FIG. 4 according to an embodiment of the invention.

FIG. 6 is a schematic circuit block diagram of the anti-interference circuit 420 depicted in FIG. 4 according to an embodiment of the invention. In the embodiment illustrated in FIG. 6, the timing controller 420 includes an interference detector circuit 421 and a control circuit 422. The interference detector circuit 421 may detect the input signal 40 or the output data D2 to obtain a detection result. The detection result may indicate whether the interference event occurs. The control circuit 422 is coupled to the interference detector circuit 421 to receive the detection result. The control circuit 422 may determine whether to adjust the at least one operation parameter of the receiving circuit 411 according to the detection result.

The occurrence of the interference event includes the occurrence of one or more of a common-mode error event, a swing error event, a high frequency event and an error code event. Based on a design requirement, the interference detector circuit 421 may include one of the following, a common-mode level detection circuit, a swing detection circuit, a high frequency detection circuit, an error detection circuit and/or other detection circuits. The common-mode level detection circuit may detect whether a common-mode error event with respect to the input signal 40 occurs. The swing detection circuit may detect whether a swing error event with respect to the input signal 40 occurs. The high frequency detection circuit may detect whether a high frequency event with respect to the input signal 40 occurs. The error detection circuit may detect whether an error code event with respect to the output data D2 occurs. Several embodiments are provided below to describe implementation details related to the common-mode level detection circuit, the swing detection circuit, the high frequency detection circuit and the error detection circuit. The control circuit 422 may count an occurrence number of one or more of the common-mode error event, the swing error event and the error code event and determine whether to adjust the at least one operation parameter of the receiving circuit 411 according to the occurrence number.

The common-mode level detection circuit in the interference detector circuit 421 may detect the common-mode level of the input signal 40, so as to determine whether the common-mode error event (i.e., the interference event) with respect to the common-mode level of the input signal 40 occurs. When the common-mode level detection circuit (i.e., the interference detector circuit 421) notifies the control circuit 422 that the common-mode error event occurs to the input signal 40 (i.e., the interference event occurs), the control circuit 422 may determine whether to adjust the at least one operation parameter of the receiving circuit 411 according to the notification of the common-mode level detection circuit.

Figure 7:
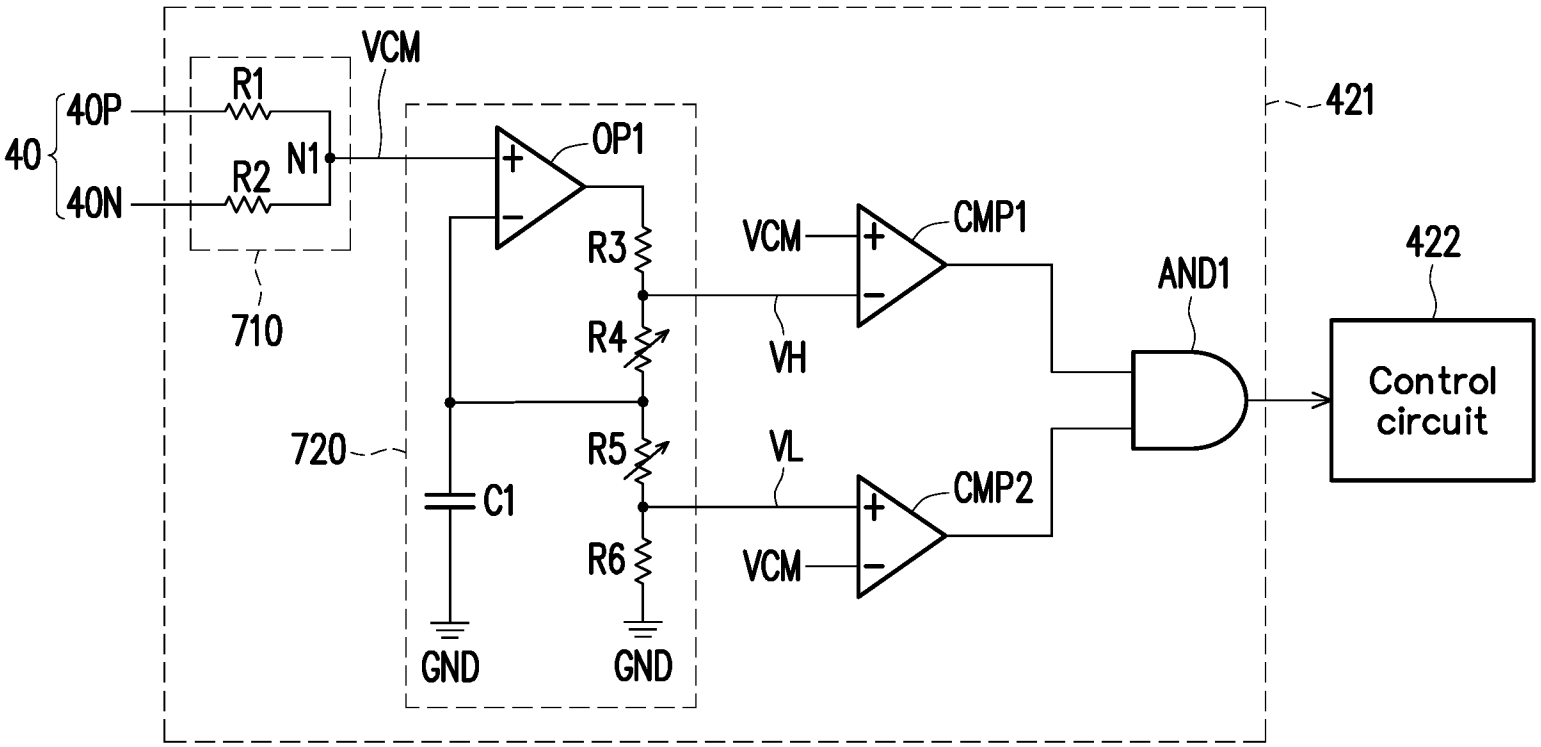
FIG. 7 is a schematic circuit block diagram of the common-mode level detection circuit in the interference detector circuit according to an embodiment of the invention.

FIG. 7 is a schematic circuit block diagram of a common-mode level detection circuit in the interference detector circuit 421 according to an embodiment of the invention. The interference detector circuit 421 and the control circuit 422 illustrated in FIG. 7 may refer to the description related to FIG. 6 and thus, will not be repeated. In the embodiment illustrated in FIG. 7, the common-mode level detection circuit of the interference detector circuit 421 includes a common-mode voltage detection circuit 710, a reference voltage generating circuit 720, a first comparator CMP1, a second comparator CMP2 and an AND gate AND1. The common-mode voltage detection circuit 710 may detect a common-mode level VCM of the input signal 40. The reference voltage generating circuit 720 is coupled to the common-mode voltage detection circuit 710 to receive the common-mode level VCM. The reference voltage generating circuit 720 may generate a first reference level VH and a second reference level VL based on the common-mode level VCM. The reference voltage generating circuit 720 may provide the first reference level VH and the second reference level VL to the first comparator CMP1 and the second comparator CMP2.

In the embodiment illustrated in FIG. 7, the common-mode voltage detection circuit 710 includes resistors R1 and R2. The input signal 40 may be a differential signal. A first terminal of the resistor R1 receives the first terminal signal 40P of the input signal 40, and a first terminal of the resistor R2 receives the second terminal signal 40N of the input signal 40. A second terminal of the resistor R1 and a second terminal of the resistor R2 are commonly coupled to a common-mode node N1 providing the common-mode level VCM to the first comparator CMP1 and the second comparator CMP2.

The reference voltage generating circuit 720, for example, includes an operational amplifier OP1, resistors R3, R4, R5 and R6 and a capacitor C1. A first input terminal (for example, a non-inverting input terminal) of the operational amplifier OP1 is coupled to the common-mode voltage detection circuit 710 to receive the common-mode level VCM. A first terminal of the resistor R3 is coupled to an output terminal of the operation amplifier OP1. A second terminal of the resistor R3 may provide the first reference level VH to the first comparator CMP1. A first terminal of the resistor R4 is coupled to the second terminal of the resistor R3. A second terminal of the resistor R4 is coupled to a second input terminal (for example, an inverting input terminal) of the operation amplifier OP1. A first terminal of the resistor R5 is coupled to the second terminal of the resistor R4. A second terminal of the resistor R5 may provide the second reference level VL to the second comparator CMP2. A first terminal of the resistor R6 is coupled to the second terminal of the resistor R5. A second terminal of the resistor R6 is coupled to a reference voltage (for example, a ground voltage GND or any other fixed voltage). A first terminal of the capacitor C1 is coupled to the second input terminal of the operation amplifier OP1. A second terminal of the capacitor C1 is coupled to the reference voltage (for example, the ground voltage GND or any other fixed voltage).

In the embodiment illustrated in FIG. 7, a first input terminal (for example, a non-inverting input terminal) of the first comparator CMP1 is coupled to the common-mode voltage detection circuit 710 to receive the common-mode level VCM. A second input terminal (for example, an inverting input terminal) of the first comparator CMP1 is coupled to the common-mode voltage detection circuit 710 to receive the first reference level VH. The first comparator CMP1 may compare the common-mode level VCM with the first reference level VH to output a first comparison result to the AND gate AND1. A first input terminal (for example, a non-inverting input terminal) of the second comparator CMP2 is coupled to the common-mode voltage detection circuit 710 to receive the second reference level VL. A second input terminal (for example, an inverting input terminal) of the second comparator CMP2 is coupled to the common-mode voltage detection circuit 710 to receive the common-mode level VCM. The second comparator CMP2 may compare the common-mode level VCM with the second reference level VL to output a second comparison result to the AND gate AND1. A first input terminal of the AND gate AND1 is coupled to the first comparator CMP1 to receive the first comparison result. A second input terminal of the AND gate AND1 is coupled to the second comparator CMP2 to receive the second comparison result. An output terminal of the AND gate AND1 is coupled to the control circuit 422 to provide the detection result to the control circuit 422.

When the RF noise 111 does not occur yet, or the energy of the RF noise 111 is insufficient to interfere with the input signal 40, the common-mode level VCM falls within a range between the first reference level VH and the second reference level VL. When the common-mode level VCM falls within the range between the first reference level VH and the second reference level VL, the output of the AND gate AND1 is at a low logic level. When the energy of the RF noise in the input signal 40 is sufficiently large, the common-mode level VCM may probably be greater than the first reference level VH, or the common-mode level VCM may probably be smaller than the second reference level VL. When the common-mode level VCM is greater than the first reference level VH, or the common-mode level VCM is smaller than the second reference level VL, the output of the AND gate AND1 is at a high logic level, thereby indicating that the common-mode error event (i.e., the interference event) has occurred to the input signal 40.

It should be noted that the implementation manner of the common-mode level detection circuit in the interference detector circuit 421 should not be limited to the disclosure illustrated in FIG. 7. For example, in other embodiments, the first reference level VH and/or the second reference level VL may be configured as fixed voltage levels. The first reference level VH and/or the second reference level VL may be any voltage levels determined based on a design requirement. For example, in an embodiment, the first reference level VH and the second reference level VL may respectively be an upper limit level and a lower limit level of a rated range of the common-mode level VCM in a normal operation state. When the RF noise 111 does not occur yet, or the energy of the RF noise 111 is insufficient to interfere with the input signal 40, the common-mode level VCM falls within the rated range.

Figure 8:
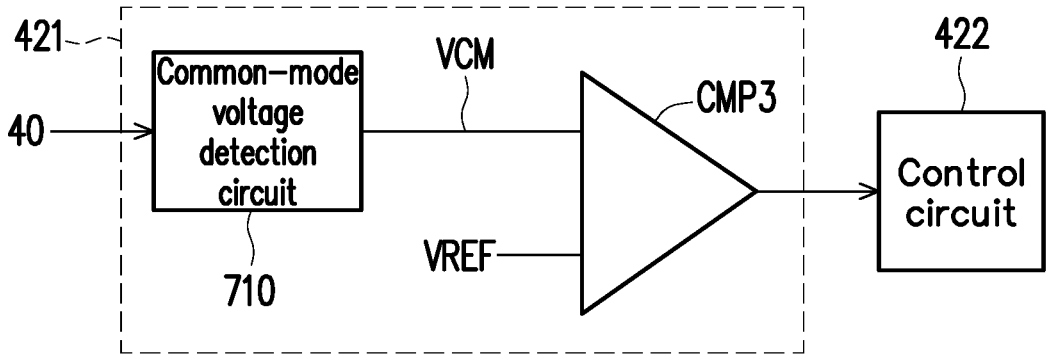
FIG. 8 is a schematic circuit block diagram of the common-mode level detection circuit in the interference detector circuit according to another embodiment of the invention.

FIG. 8 is a schematic circuit block diagram of the common-mode level detection circuit in the interference detector circuit 421 according to another embodiment of the invention. The interference detector circuit 421 and the control circuit 422 illustrated in FIG. 8 may refer to the description related to FIG. 6 and thus, will not be repeated. In the embodiment illustrated in FIG. 8, the common-mode level detection circuit of the interference detector circuit 421 includes a common-mode voltage detection circuit 710 and a comparator CMP3. The sensing circuit 710 illustrated in FIG. 8 may refer to the description related to FIG. 7 and thus, will not be repeatedly described.

A first input terminal of the comparator CMP3 is coupled to the common-mode voltage detection circuit 710 to receive the common-mode level VCM. A second input terminal of the comparator CMP3 receives a reference voltage VREF. The reference level VREF may be any voltage level determined based on a design requirement. The comparator CMP3 may compare the common-mode level VCM with the reference level VREF to obtain a comparing result. An output terminal of the comparator CMP3 is coupled to the control circuit 422 to provide the detection result according to the comparison result.

For example, in an embodiment, the reference level VREF may be an upper limit level of a rated range of the common-mode level VCM in a normal operation state. When the RF noise 111 does not occur yet, or the energy of the RF noise 111 is insufficient to interfere with the input signal 40, the common-mode level VCM falls within the rated range. When the common-mode level VCM is smaller than the reference level VREF, the output of the comparator CMP3 is at a low logic level. When the energy of the RF noise in the input signal 40 is sufficiently large, the common-mode level VCM may probably be greater than the reference level VREF. When the common-mode level VCM is greater than the reference level VREF, the output of the comparator CMP3 is at a high logic level, thereby indicating that the common-mode error event (i.e., the interference event) has occurred to the input signal 40.

In another embodiment, the reference level VREF may be a lower limit level of the rated range of the common-mode level VCM in a normal operation state. When the RF noise 111 does not occur yet, or the energy of the RF noise 111 is insufficient to interfere with the input signal 40, the common-mode level VCM falls within the rated range. When the common-mode level VCM is greater than the reference level VREF, the output of the comparator CMP3 is at a low logic level. When the energy of the RF noise in the input signal 40 is sufficiently large, the common-mode level VCM may probably be smaller than the reference level VREF. When the common-mode level VCM is smaller than the reference level VREF, the output of the comparator CMP3 is at a high logic level, thereby indicating that the common-mode error event (i.e., the interference event) has occurred to the input signal 40.

The swing detection circuit in the interference detector circuit 421 may detect a swing of the input signal 40, so as to determine whether the swing error event (i.e., the interference event) with respect to the swing of the input signal 40 occurs. When the swing detection circuit (i.e., the interference detector circuit 421) notifies the control circuit 422 that the swing error event occurs to the input signal 40 (i.e., the interference event occurs), the control circuit 422 may determine whether to adjust the at least one operation parameter of the receiving circuit 411 according to the notification of the swing detection circuit.

Figure 9:
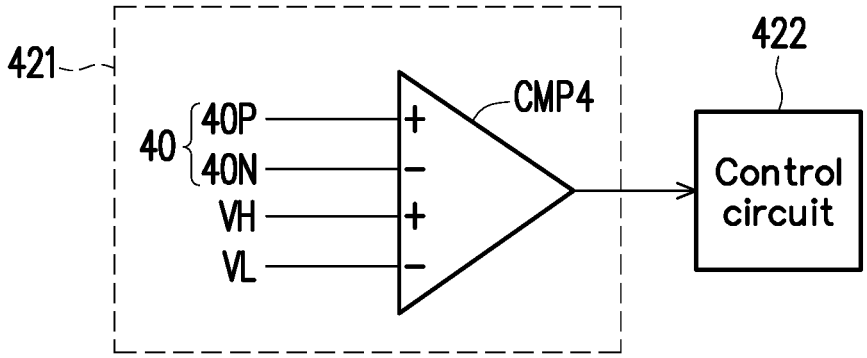
FIG. 9 is a schematic circuit block diagram of the swing detection circuit in the interference detector circuit according to an embodiment of the invention.

FIG. 9 is a schematic circuit block diagram of the swing detection circuit in the interference detector circuit 421 according to an embodiment of the invention. The interference detector circuit 421 and the control circuit 422 illustrated in FIG. 9 may refer to the description related to FIG. 6 and thus, will not be repeated. In the embodiment illustrated in FIG. 9, the swing detection circuit in the interference detector circuit 421 includes a comparator CMP4. A first differential input terminal pair of the comparator CMP4 may receive the first terminal signal 40P and the second terminal signal 40N in the input signal 40. A second differential input terminal pair of the comparator CMP4 may receive the first reference level VH and the second reference level VL. An output terminal of the comparator CMP4 is coupled to the control circuit 422 to provide the detection result.

The comparator CMP4 may compare whether the swing of the input signal 40 exceeds a rated range defined by the first reference level VH and the second reference level VL. When the RF noise 111 does not occur yet, or the energy of the RF noise 111 is insufficient to interfere with the input signal 40, the swing of the input signal 40 falls within the rated range. When the swing of the input signal 40 falls within the rated range, the output of the comparator CMP4 is at a low logic level. When the energy of the RF noise in the input signal 40 is sufficiently large, the swing of the input signal 40 may probably exceed the rated range. When the swing of the input signal 40 exceeds the rated range, the output of the comparator CMP4 is at a high logic level, thereby indicating that the swing error event (i.e., the interference event) has occurred to the input signal 40.

It should be noted that in some embodiments, a method of generating the first reference level VH and the second reference level VL illustrated in FIG. 9 may be inferred with reference to the description related to the reference voltage generating circuit 720 illustrated in FIG. 7 and thus, will not be repeated. Namely, the first reference level VH and/or the second reference level VL may be dynamic voltage levels in response to the common-mode level VCM of the input signal 40. In other embodiments, the first reference level VH and/or the second reference level VL may be configured as any fixed voltage levels. The voltage levels of the first reference level VH and/or the second reference level VL may be determined based on a design requirement in a scenario where they are configured as fixed voltages. For example, the first reference level VH and the second reference level VL may respectively be an upper limit level and a lower limit level of a rated swing range of the input signal 40 in a normal operation state. When the RF noise 111 does not occur yet, or the energy of the RF noise 111 is insufficient to interfere with the input signal 40, the swing of the input signal 40 falls within the rated swing range.

The high frequency detection circuit in the interference detector circuit 421 may detect the frequency of the input signal 40. Generally, a frequency of the RF noise is higher than the frequency of the input signal 40. Thus, when the high frequency detection circuit detects that the high frequency event occurs to the input signal 40, the high frequency detection circuit may determine that the interference event occurs to the input signal 40. When the high frequency detection circuit in the interference detector circuit 421 notifies the control circuit 422 that the high frequency event (i.e., the interference event) occurs to the input signal 40, the control circuit 422 may determine whether to adjust the at least one operation parameter of the receiving circuit 411 according to the notification of the high frequency detection circuit.

Figure 10:
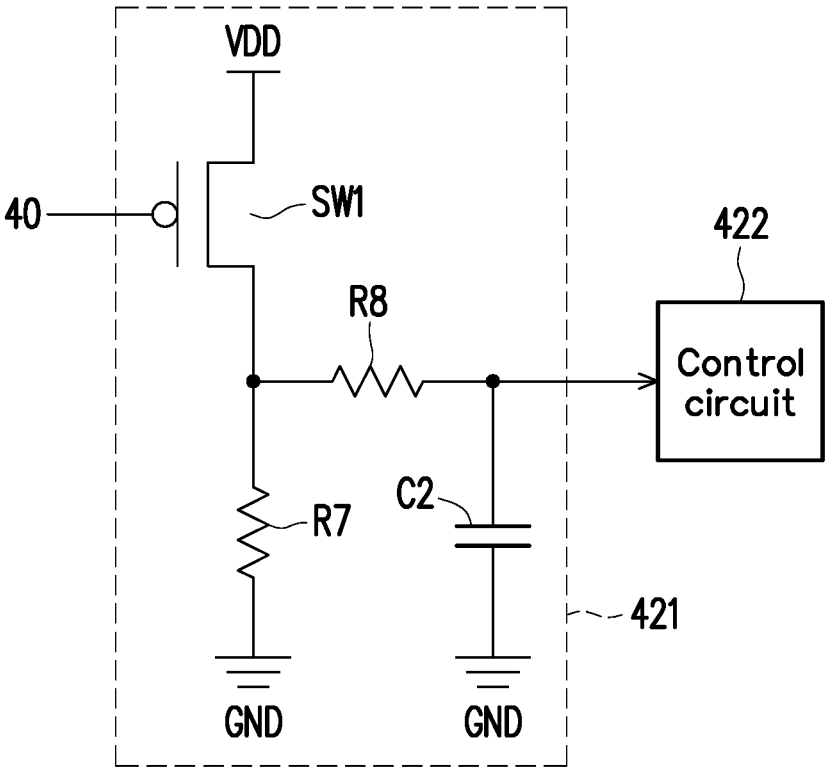
FIG. 10 is a schematic circuit block diagram of the high frequency detection circuit in the interference detector circuit according to an embodiment of the invention.

FIG. 10 is a schematic circuit block diagram of the high frequency detection circuit in the interference detector circuit 421 according to another embodiment of the invention. The interference detector circuit 421 and the control circuit 422 illustrated in FIG. 10 may refer to the description related to FIG. 6 and thus, will not be repeated. In the embodiment illustrated in FIG. 10, the high frequency detection circuit of the interference detector circuit 421 includes a switch SW1, resistors R7 and R8 and a capacitor C2. A first terminal of the switch SW1 is coupled to a first voltage (for example, a system voltage VDD). A control terminal of the switch SW1 receives the input signal 40. In a condition that the input signal 40 is a differential signal, the control terminal of the switch SW1 may receive the first terminal signal 40P or the second terminal signal 40N of the input signal 40.

A first terminal of the resistor R7 is coupled to a second terminal of the switch SW1. A second terminal of the resistor R7 is coupled to a second voltage (for example, a ground voltage GND). A first terminal of the resistor R8 is coupled to the second terminal of the switch SW1. A second terminal of the resistor R8 is coupled to the control circuit 422 to provide the detection result. A first terminal of the capacitor C2 is coupled to the second terminal of the resistor R8. A second terminal of the capacitor C2 is coupled to a third voltage (for example, a ground voltage GND). A turn-on frequency of the switch SW1 is in response to the frequency of the input signal 40. When the switch SW1 is turned on, the system voltage VDD may charge the capacitor C2 via the resistor R8. On the other hand, the charge stored in the capacitor C2 may be released (discharged) via the resistors R8 and R7. When a speed of the charging is greater than a speed of the discharging, a voltage (i.e., the detection result) of the capacitor C2 is pulled up. In other words, when the high frequency event occurs to the input signal 40, the voltage of the capacitor C2 is pulled up. The control circuit 422 may acquire whether the high frequency event (i.e., the interference event) occurs to the input signal 40 according to the voltage of the capacitor C2. Thus, the high frequency detection circuit in the interference detector circuit 421 may detect the frequency of the input signal 40, so as to determine whether the high frequency event (i.e., the interference event) occurs to the input signal 40.

The error detection circuit in the interference detector circuit 421 may detect a bit error rate (or an error code count) of the output data D2, so as to determine whether the error code event (i.e., the interference event) occurs to the output data D2. For example, according to a specific transmission protocol (i.e., a specific transmission format), a specific bit (or some specific bits) of a specific position in the output data D2 certainly has a specific specified pattern (for example, "01"). If the specified pattern does not appear to the specific position, the error detection circuit may acquire that errors occur to the output data D2. By calculating a count (i.e., the error code count) of the errors occurring to the output data D2 or a frequency (i.e., the bit error rate) of the errors occurring to the output data D2, the error detection circuit may determine whether the error code event occurs to the output data D2. When the error detection circuit (i.e., the interference detector circuit 421) notifies the control circuit 422 that the error code event (i.e., the interference event) occurs to the output data D2, the control circuit 422 may determine whether to adjust the at least one operation parameter of the receiving circuit 411 according to the notification of the error detection circuit.

Figure 11:
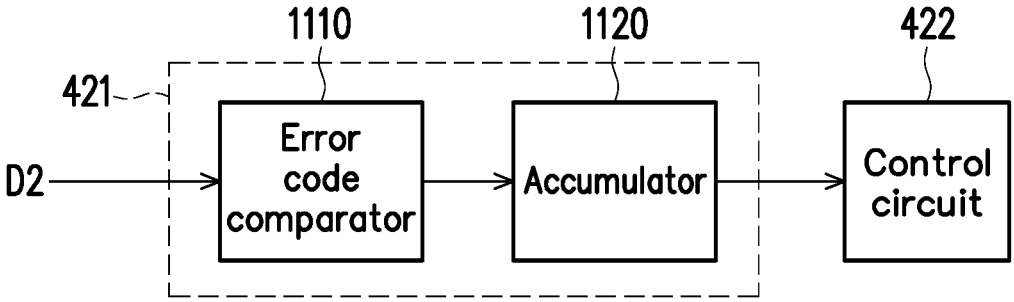
FIG. 11 is a schematic circuit block diagram of the error detection circuit in the interference detector circuit according to an embodiment of the invention.

FIG. 11 is a schematic circuit block diagram of the error detection circuit in the interference detector circuit 421 according to an embodiment of the invention. The interference detector circuit 421 and the control circuit 422 illustrated in FIG. 11 may refer to the description related to FIG. 6 and thus, will not be repeated. In the embodiment illustrated in FIG. 11, the error detection circuit of the interference detector circuit 421 includes an error code comparator 1110 and an accumulator 1120. The error code comparator 1110 is coupled to the receiving circuit 411 to receive the output data D2. The error code comparator 1110 may compare the output data D2 with a specific transmission format to obtain an identification result indicating whether the output data D2 meets the transmission format. The transmission format may be determined based on a design requirement and is not limited in the present embodiment.

For example, according to a specific transmission protocol (i.e., a transmission format), a specific bit (or some specific bits) of a specific position in the output data D2 certainly has a specific specified pattern (for example, "01"). If the specified pattern does not appear to the specific position, the error code comparator 1110 may acquire that errors occur to the output data D2. Thus, the error code comparator 1110 may output a logic value of "1" (i.e., an identification result) to the accumulator 1120. If the output data D2 meets the transmission format, the error code comparator 1110 may output a logic value of "0" (i.e., an identification result) to the accumulator 1120.

An input terminal of the accumulator 1120 is coupled to an output terminal of the error code comparator 1110 to receive the identification results. The accumulator 1120 accumulates the identification results to obtain an accumulation result. When the output of the error code comparator 1110 is 1, the accumulation result of the accumulator 1120 is added by 1. When the accumulation result exceeds a specific predetermined number, the accumulation result indicates whether the error code event (i.e., the interference event) occurs. The predetermined number may be determined based on a design requirement and is not limited in the present embodiment. Thus, the error detection circuit in the interference detector circuit 421 may detect whether errors occur to the output data D2, so as to determine whether the error code event (i.e., the interference event) occurs to the output data D2.

Figure 12:
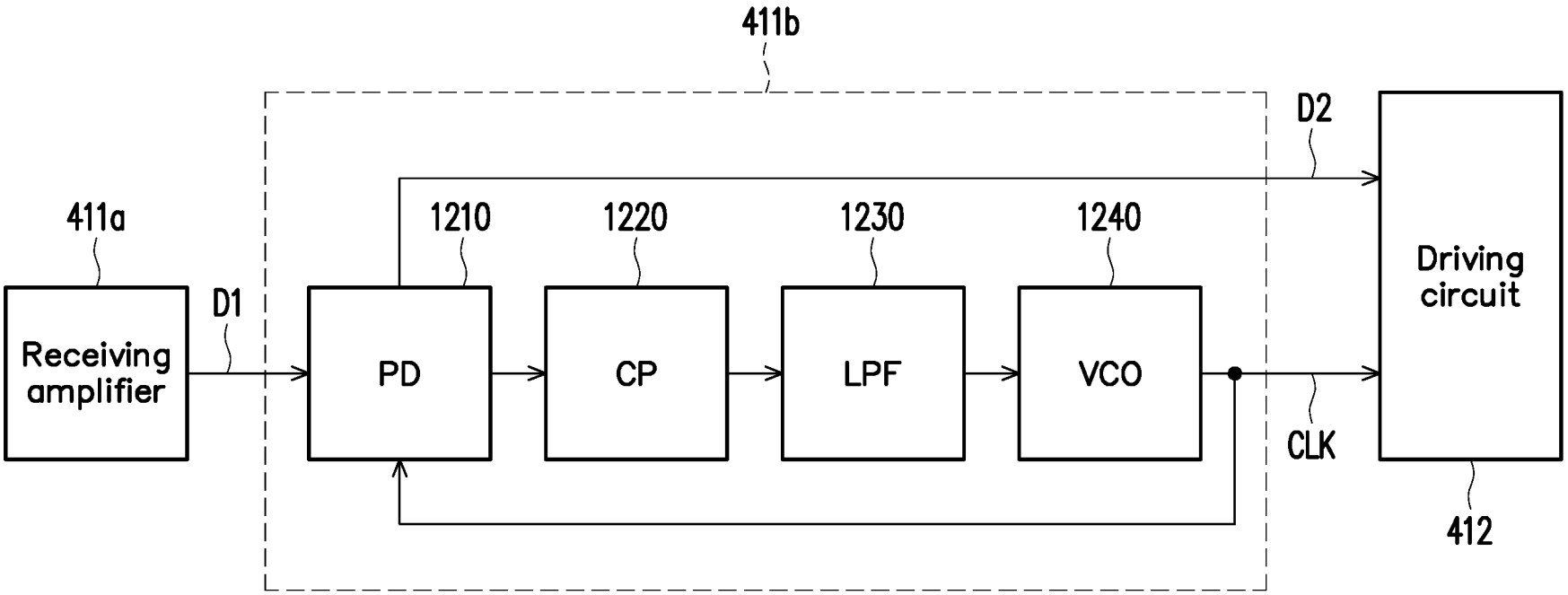
FIG. 12 is a schematic circuit block diagram of the clock and data recovery (CDR) circuit depicted in FIG. 4 according to an embodiment of the invention.

FIG. 12 is a schematic circuit block diagram of the CDR circuit 411*b* depicted in FIG. 4 according to an embodiment of the invention. In the embodiment illustrated in FIG. 12, the CDR circuit 411*b* includes phase detector (PD) 1210, a charge pump (CP) 1220, a low pass filter (LPF) 1230 and a voltage controlled oscillator (VCO) 1240. The PD 1210 receives the input signal D1 from the receiving amplifier 411*a* and receives an output clock CLK from the VCO 1240. According to a phase of the output clock CLK, the PD 1210 may sample a data component from the input signal D1 to generate the output data D2 to the driving circuit 412. In addition, the PD 1210 may compare/detect a phase relation between a clock component and the output clock CLK of the input signal D1 and then, provide the detection result to the CP 1220.

An input terminal of the CP 1220 is coupled to an output terminal of the PD 1210. An input terminal of the LPF 1230 is coupled to an output terminal of the CP 1220. An input terminal of the VCO 1240 is coupled to an output terminal of the LPF 1230. The PD 1210, the CP 1220, the LPF 1230 and the VCO 1240 are not limited in the present embodiment. For example, the PD 1210 may be a conventional phase detector or other phase detectors, the CP 1220 may be a conventional charge pump or other charge pumps, the LPF 1230 may be a conventional low pass filter or other low pass filters, and the VCO 1240 may be a conventional voltage controlled oscillator or other voltage controlled oscillators. The output clock CLK generated by the VCO 1240 may be provided to the driving circuit 412.

When the interference event occurs to the input signal 40, the anti-interference circuit 420 may selectively adjust the at least one operation parameter of the CDR circuit 411*b*. Based on a design requirement, the at least one operation parameter of the CDR circuit 411*b* includes at least one of a CP current of the CP 1220 and an LPF resistance of the LPF 1230. For example, when the interference event occurs to the input signal 40, the anti-interference circuit 420 may selectively decrease the CP current of the CP 1220 and/or selectively decrease the LPF resistance of the LPF 1230, thereby adjusting the bandwidth of the CDR circuit 411*b*.

Based on different design demands, blocks of the anti-interference circuit 420 and/or the control circuit 422 may be implemented in a form of hardware, firmware, software (i.e., programs) or in a combination of many of the aforementioned three forms.

In terms of the hardware form, the blocks of the anti-interference circuit 420 and/or the control circuit 422 may be implemented in a logic circuit on the integrated circuit. Related functions of the anti-interference circuit 420 and/or the control circuit 422 may be implemented in a form of hardware by utilizing hardware description languages (e.g., Verilog HDL or VHDL) or other suitable programming languages. For example, the related functions of the anti-interference circuit 420 and/or the control circuit 422 may be implemented in one or more controllers, micro-controllers, microprocessors, application-specific integrated circuits (ASICs), digital signal processors (DSPs), field programmable gate arrays (FPGAs) and/or various logic blocks, modules and circuits in other processing units.

In terms of the software form and/or the firmware form, the related functions of the anti-interference circuit 420 and/or the control circuit 422 may be implemented as programming codes. For example, the anti-interference circuit 420 and/or the control circuit 422 may be implemented by using general programming languages (e.g., C or C++) or other suitable programming languages. The programming codes may be recorded/stored in recording media. The aforementioned recording media include a read only memory (ROM), a storage device and/or a random access memory (RAM). Additionally, the programming codes may be accessed from the recording medium and executed by a computer, a central processing unit (CPU), a controller, a micro-controller or a microprocessor to accomplish the related functions. As for the recording medium, a non-transitory computer readable medium, such as a tape, a disk, a card, a semiconductor memory or a programming logic circuit, may be used. In addition, the programs may be provided to the computer (or the CPU) through any transmission medium (e.g., a communication network or radio waves). The communication network is, for example, the Internet, wired communication, wireless communication or other communication media.

Based on the above, the receiving circuit of the integrated circuit provided by the embodiments of the invention can process the input signal based on the at least one operation parameter, so as to generate the output data to other internal circuits (for example, the driving circuit). The anti-interference circuit of the integrated circuit can determine whether any interference event occurs to the input signal, so as to determine whether to adjust the at least one operation parameter of the receiving circuit according to the determination result. The at least one operation parameter may include one or more of the high frequency gain, the low frequency gain, the ratio of the high frequency gain to the low frequency gain, the bias current, the resistance value, the capacitance value and other operation parameters of the receiving circuit. When detecting the occurrence of the interference event, the anti-interference circuit can dynamically adjust the at least one operation parameter of the receiving circuit, so as to automatically resist the interference. After the noise disappears, the anti-interference circuit can automatically return the at least one operation parameter of the receiving circuit back to the at least one normal parameter. In this way, when the noise comes (i.e., the interference event occurs), the anti-interference circuit can automatically change the related operation parameters. After the noise disappears, the anti-interference circuit can automatically return the at least one operation parameter back to the normal parameter to prevent unnecessary current consumption.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An integrated circuit, configured to drive a display panel, comprising:

a source driving circuit, comprising a receiving circuit, and configured to receive an input signal comprising image data and process the input signal based on at least one operation parameter to generate output data; and an anti-interference circuit, coupled to the receiving circuit, determining whether an interference event occurs to the input signal based on the input signal or the output data to obtain a determination result and determining whether to adjust the at least one operation parameter of the receiving circuit according to the determination result.

2. The integrated circuit according to claim 1, wherein the anti-interference circuit detects at least one of a frequency of the input signal, a common-mode level of the input signal, a swing of the input signal and an error code count of the output data to obtain a detection result and determines whether to adjust the at least one operation parameter of the receiving circuit according to the detection result.

3. The integrated circuit according to claim 1, wherein the anti-interference circuit comprises:

an interference detector circuit, configured to detect the input signal or the output data to obtain a detection result indicating whether the interference event occurs; and a control circuit, coupled to the interference detector circuit to receive the detection result and determining whether to adjust the at least one operation parameter of the receiving circuit according to the detection result.

4. The integrated circuit according to claim 3, wherein the interference detector circuit comprises at least one of:

a common-mode level detection circuit, configured to detect whether a common-mode error event with respect to a common-mode level of the input signal occurs;

a swing detection circuit, configured to detect whether a swing error event with respect to a swing of the input signal occurs;

a high frequency detection circuit, configured to detect whether a high frequency event with respect to the input signal occurs; and an error detection circuit, configured to detect whether an error code event with respect to the output data occurs, wherein the occurrence of the interference event comprises occurrence of one or more of the common-mode error event, the swing error event, the high frequency event and the error code event.

5. The integrated circuit according to claim 4, wherein the control circuit counts an occurrence number of the one or more of the common-mode error event, the swing error event and the error code event and determines whether to adjust the at least one operation parameter of the receiving circuit according to the occurrence number.

6. The integrated circuit according to claim 4, wherein the common-mode level detection circuit comprises:

a common-mode voltage detection circuit, configured to detect the common-mode level of the input signal.

7. The integrated circuit according to claim 6, wherein the common-mode level detection circuit further comprises:

a first comparator, coupled to the common-mode voltage detection circuit to receive the common-mode level and comparing the common-mode level with a first reference level to output a first comparison result;

a second comparator, coupled to the common-mode voltage detection circuit to receive the common-mode level and comparing the common-mode level with a second reference level to output a second comparison result; and an AND gate, having a first input terminal coupled to the first comparator to receive the first comparison result, a second input terminal coupled to the second comparator to receive the second comparison result and an output terminal coupled to the control circuit to provide the detection result.

8. The integrated circuit according to claim 6, wherein the common-mode level detection circuit further comprises:

a comparator, having an input terminal coupled to the common-mode voltage detection circuit to receive the common-mode level, comparing the common-mode level with a reference level to obtain a comparison result and having an output terminal coupled to the control circuit to provide the detection result according to the comparison result.

9. The integrated circuit according to claim 6, wherein the common-mode level detection circuit comprises:

a first resistor, having a first terminal configured to receive a first terminal signal in the input signal and a second terminal coupled to a common-mode node, wherein the common-mode node provides the common-mode level to the first comparator and the second comparator; and a second resistor, having a first terminal configured to receive a second terminal signal in the input signal and a second terminal coupled to the common-mode node.

10. The integrated circuit according to claim 7, wherein the interference detector circuit further comprises:

a reference voltage generating circuit, coupled to the common-mode voltage detection circuit to receive the common-mode level and generating the first reference level and the second reference level based on the common-mode level.

11. The integrated circuit according to claim 10, wherein the reference voltage generating circuit comprises:

an operational amplifier, having a first input terminal coupled to the common-mode voltage detection circuit to receive the common-mode level;

a first resistor, having a first terminal coupled to an output terminal of the operational amplifier and a second terminal providing the first reference level to the first comparator;

a second resistor, having a first terminal coupled to the second terminal of the first resistor and a second terminal coupled to a second input terminal of the operational amplifier;

a third resistor, having a first terminal coupled to the second terminal of the second resistor and a second terminal providing the second reference level to the second comparator; and a fourth resistor, having a first terminal coupled to the second terminal of the third resistor and a second ten al coupled to a reference voltage.

12. The integrated circuit according to claim 4, wherein the swing detection circuit comprises:

a comparator, having a first differential input terminal pair and a second differential input terminal pair, wherein the first differential input terminal pair is configured to receive a first terminal signal and a second terminal signal in the input signal, the second differential input terminal pair is configured to receive a first reference level and a second reference level, and an output terminal of the comparator is coupled to the control circuit to provide the detection result.

13. The integrated circuit according to claim 4, wherein the high frequency detection circuit comprises:

a switch, having a first terminal coupled to a first voltage and a control terminal receiving the input signal;

a first resistor, having a first terminal coupled to a second terminal of the switch and a second terminal coupled to a second voltage;

a second resistor, having a first terminal coupled to the second terminal of the switch and a second terminal coupled to the control circuit to provide the detection result; and a capacitor, having a first terminal coupled to the second terminal of the second resistor and a second terminal coupled to a third voltage.

14. The integrated circuit according to claim 4, wherein the error detection circuit comprises:

an error code comparator, coupled to the receiving circuit to receive the output data and configured to compare the output data and a transmission format to obtain an identification result indicating whether the output data meets the transmission format; and an accumulator, having an input terminal coupled to the error code comparator to receive the identification result and accumulating the identification result to obtain an accumulation result indicating that the error code event occurs when the accumulation result exceeds a predetermined number.

15. The integrated circuit according to claim 1, wherein the receiving circuit comprises:

a receiving amplifier, configured to receive the input signal; and a clock and data recovery circuit, configured to recover the image data and a clock from the input signal based on the at least one operation parameter to generate the output data and an output clock.

16. An anti-interference method of an integrated circuit configured to drive a display panel, comprising:

receiving an input signal comprising image data by a receiving circuit of a source driving circuit in an integrated circuit;

processing the input signal based on at least one operation parameter by the receiving circuit to generate output data;

determining whether an interference event occurs to the input signal based on the input signal or the output data by an anti-interference circuit to obtain a determination result; and determining whether to adjust the at least one operation parameter of the receiving circuit according to the determination result by the anti-interference circuit.

17. The anti-interference method according to claim 16, wherein the step of determining whether the interference event occurs to the input signal comprises:

detecting at least one of a frequency of the input signal, a common-mode level of the input signal, a swing of the input signal and an error code count of the output data to obtain a detection result; and determining whether to adjust the at least one operation parameter of the receiving circuit according to the detection result by the anti-interference circuit.

* * * * *